US008096534B2

(12) United States Patent
Vasudevan et al.

(10) Patent No.: US 8,096,534 B2
(45) Date of Patent: Jan. 17, 2012

(54) WATER DISTRIBUTION TRAY

(75) Inventors: Geethakrishnan Vasudevan, Irving, TX (US); Robert B. Uselton, Plano, TX (US); Jesse Sanchez, Mansfield, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days.

(21) Appl. No.: 13/090,660

(22) Filed: Apr. 20, 2011

(65) Prior Publication Data

US 2011/0193246 A1 Aug. 11, 2011

Related U.S. Application Data

(63) Continuation of application No. 11/876,266, filed on Oct. 22, 2007, now Pat. No. 7,950,631.

(51) Int. Cl.
*B01F 3/04* (2006.01)

(52) U.S. Cl. ..... 261/97; 261/106

(58) Field of Classification Search ..... 261/23.1, 261/97, 106, 110, DIG. 15
See application file for complete search history.

(56) References Cited

U.S. PATENT DOCUMENTS

| | | | | |
|---|---|---|---|---|
| 2,281,799 | A | 5/1942 | Quave | |
| 3,570,822 | A | 3/1971 | Peterson et al. | |
| 3,975,470 | A | 8/1976 | Engel | |
| 4,125,576 | A | 11/1978 | Kozinski | |
| 4,158,679 | A | 6/1979 | Yeagle | |
| 4,460,520 | A | 7/1984 | Wrightson | |
| 4,562,016 | A | 12/1985 | Colliver | |
| 4,657,709 | A | 4/1987 | Goettl | |
| 5,851,444 | A | 12/1998 | Hansell, Jr. et al. | |
| 5,853,625 | A | 12/1998 | Kensok et al. | |
| 5,919,533 | A | 7/1999 | Smith et al. | |
| 5,932,148 | A | 8/1999 | Hansell, Jr. et al. | |
| 5,971,366 | A | 10/1999 | Smith | |
| 6,367,782 | B1 | 4/2002 | Guetersloh | |
| 7,950,631 | B2 * | 5/2011 | Vasudevan et al. | 261/97 |
| 2009/0102073 | A1 | 4/2009 | Vasudevan et al. | |

* cited by examiner

*Primary Examiner* — Charles Bushey

(57) ABSTRACT

A water distribution tray having an improvement including a first downwardly inclined surface therein commencing at a base of a water impingement pedestal within a first of a plurality of channels and ending at a corresponding first of a plurality of discharge apertures, wherein the first downwardly inclined surface has a first declension angle associated therewith, and a second downwardly inclined surface commencing at the base within a second of the plurality of channels and ending at a corresponding second of the plurality of discharge apertures, wherein the second downwardly inclined surface has a second declension angle associated therewith different from the first declension angle. A method of manufacturing is also provided.

24 Claims, 2 Drawing Sheets

| | | DISCHARGE APERTURE | | | | | | | | |
|---|---|---|---|---|---|---|---|---|---|---|
| | | 1 | 2 | 3 | 4 | 5 | 6 | 7 | 8 | STANDARD |
| | TILT ANGLE | PERCENT OF FLOW | | | | | | | | DEVIATION |
| CONVENTIONAL | 0° | 18.9 | 0.3 | 0.1 | 5.0 | 2.6 | 18.7 | 25.7 | 28.7 | 11.8 |
| | 2° | 14.0 | 0.2 | 2.4 | 21.4 | 18.6 | 15.0 | 11.4 | 17.1 | 7.6 |
| | 3.5° | 8.9 | 8.7 | 13.1 | 14 | 14.9 | 15.7 | 10.8 | 13.9 | 2.69 |
| PRESENT INVENTION | 0° | 12.3 | 11.2 | 12.2 | 11.1 | 13.7 | 15.0 | 12.1 | 12.5 | 1.3 |
| | 2° | 15.2 | 12.3 | 7.5 | 13.4 | 13.4 | 14.1 | 12.0 | 12.0 | 2.3 |
| | 3.5° | 14.3 | 11.9 | 8.6 | 8.5 | 16.3 | 20.0 | 9.8 | 10.6 | 4.1 |

FIG. 3

WATER DISTRIBUTION TRAY

CROSS REFERENCE RELATED APPLICATION

This application is a continuation of U.S. patent application Ser. No. 11/876,266, entitled "WATER DISTRIBUTION TRAY, filed on Oct. 22, 2007 to Geethakrishnan Vasudevan, et al now U.S. Pat. No. 7,950,631, issued May 31, 2011. The above-listed application is commonly assigned with the present invention and is incorporated herein by reference as if reproduced herein in its entirety.

TECHNICAL FIELD OF THE INVENTION

The present invention is directed, in general, to humidifiers and, more specifically, to a water distribution tray for use in a pad-type humidifier.

BACKGROUND OF THE INVENTION

In cold climates, particularly where occupied spaces must be heated, air in these spaces tends to have low relative humidity. This is uncomfortable, encourages static electricity discharges and is sometimes even unhealthy. Humidifiers are routinely used in heating, ventilation and air conditioning (HVAC) systems to add moisture to the air being conditioned to enhance the comfort of the occupants of the conditioned air space. The current relative humidity and the temperature of the air being conditioned dictate the amount of moisture added.

Humidifiers have a variety of different designs. There are small stand-alone units intended for a single room. Larger units are designed for permanent installation as a component of a central heating/HVAC system. These add moisture to the stream of heated air passing through the furnace duct to the conditioned space. The latter type of humidifier will hereafter be referred to as an "in-duct" humidifier. The humidifier whose description follows is an improvement to one common type of in-duct humidifier.

There are a number of different designs for in-duct humidifiers. The kind which is presently of interest has an air-permeable pad, typically made from a number of similarly-sized layers of thin, expanded aluminum sheet stacked to a thickness of perhaps 1.5 in. The layers of aluminum sheet are bonded to each other so as to create a pad structure having a rectangular box-like shape. The pad is placed in or near the furnace duct so that air warmed by the furnace can flow through the pad. Water is caused to drip onto the top surface of the pad at a rate which keeps the pad moist from top to bottom when humidity is demanded. The warm air passing through the pad evaporates water in the pad, adding humidity to the air and thereby raising the relative humidity.

The water flows onto the pad from what is known as a water distribution tray, or simply a tray. The tray extends along the top surface of the pad and has a reservoir for directing water flow over the pad. Water is fed to the tray from the building water supply and flow is controlled by a solenoid valve. Apertures spaced along the tray bottom permit the water flowing into the tray to fall onto the top of the pad. By properly selecting the rate at which water is added to the tray, the pad can be kept moist from top to bottom. The pad, the tray, and a frame supporting the pad and tray in the proper spatial relationship comprise the most important elements of an in-duct humidifier. It is very important, for efficient operation, that the tray evenly distributes water across the entire width of the pad.

There are water distribution trays now known which have a number of apertures spaced apart along the length of the tray and that use individual ducts, or channels, for conducting water to each aperture. Ideally, sizing and positioning the individual channels to conduct water to the apertures allows each aperture to receive an equal measure of the water; thereby assuring that the pad is evenly soaked across its width in accordance with the water demanded. These designs do not always fully realize these goals and indeed may sometimes cause further problems. For example, problems may arise that still prevent uniform saturation of the pad. This may happen if the tray is not perfectly level, thereby preventing an equal amount of water from flowing to each part of the pad's top surface. This is a fairly common problem as there is generally little need to accurately level other elements of the heating/HVAC system. Thus, when the humidifier is installed, it will usually be only as level as the air duct at that location. Water distribution will then likely favor one end of the tray over the other end.

It is also very important for all of the water in the tray to promptly drain onto the pad when the water flow stops. This eliminates un-drained pools of water standing in the tray which will evaporate leaving behind minerals, originally dissolved in the water, pooled on the tray surfaces. Over time, these mineral deposits can build up to a level which interferes with the operation of the tray itself. The use of a number of individual channels to supply water to individual holes tends to exacerbate this problem.

Accordingly, what is needed in the art is a water distribution tray that does not suffer the limitations of the prior art.

SUMMARY OF THE INVENTION

To address the above-discussed deficiencies of the prior art, the present invention provides a water distribution tray having an improvement comprising a first downwardly inclined surface therein commencing at a base of a water impingement pedestal within a first of a plurality of channels and ending at a corresponding first of a plurality of discharge apertures, wherein the first downwardly inclined surface has a first declension angle associated therewith, and a second downwardly inclined surface commencing at the base within a second of the plurality of channels and ending at a corresponding second of the plurality of discharge apertures, wherein the second downwardly inclined surface has a second declension angle associated therewith different from the first declension angle. A method of manufacturing is also provided.

The foregoing has outlined preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention.

BRIEF DESCRIPTION OF THE DRAWINGS

For a more complete understanding of the present invention, reference is now made to the following descriptions taken in conjunction with the accompanying drawings, in which:

FIG. 3 illustrates a table of comparative results testing a comparable prior art water distribution tray versus the present invention.

DETAILED DESCRIPTION

Figure 1:
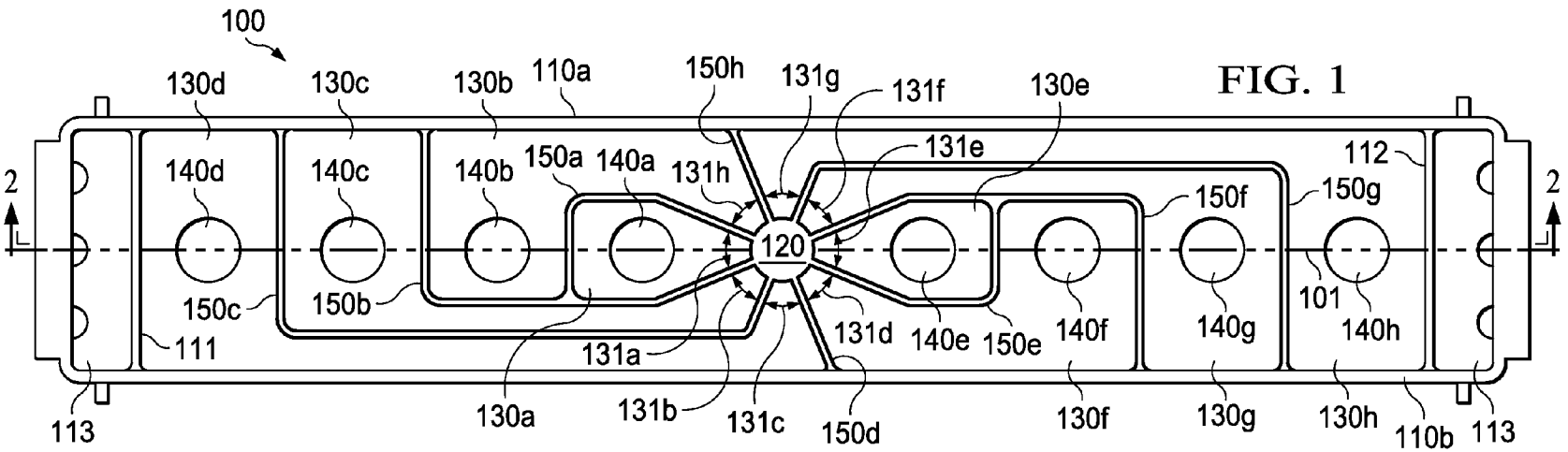
FIG. 1 illustrates a plan view of one embodiment of an in-duct, humidifier water distribution tray constructed according to the principles of the present invention.

Referring initially to FIG. 1, illustrated is a plan view of one embodiment of an in-duct, humidifier water distribution tray 100 constructed according to the principles of the present invention. The tray 100 comprises a centerline 101, first and second outer walls 110*a*, 110*b*, a bottom 113, a central water-impingement pedestal 120, a plurality of channels 130*a*-130*h*, a corresponding plurality of discharge apertures 140*a*-140*h*, a plurality of continuous inner vertical walls 150*a*-150*h*, and first and second end walls 111, 112. It should be noted that although the continuous vertical walls 150*a*-150*h* are so named, this does not mean that the faces of the walls are necessarily vertical with respect to the bottom 113. The walls 150*a*-150*h* may taper slightly as distance from the bottom increases for manufacturability. Nonetheless, a core line of the continuous vertical walls 150*a*-150*h* will remain perpendicular to the bottom 113. Vertical for the purpose of this discussion will be defined as normal to the bottom 113.

The plurality of discharge apertures 140*a*-140*h* are each associated with the plurality of channels 130*a*-130*h*. Each of the plurality of channels 130*a*-130*h* is defined by one or more of the continuous vertical walls 150*a*-150*h* in combination or combined with at least a portion of the first and second outer walls 110*a*, 110*b*, or the end walls 111, 112. For example, the eighth channel 130*h* is defined as the area bounded by: inner vertical wall 150*h*, first outer wall 110*a*, second end wall 112, second outer wall 110*b* and inner vertical wall 150*g*. At the central water-impingement pedestal 120, each of the plurality of channels 130*a*-130*h* comprises corresponding equal angles 131*a*-131*h* of about 45°.

Figure 2:
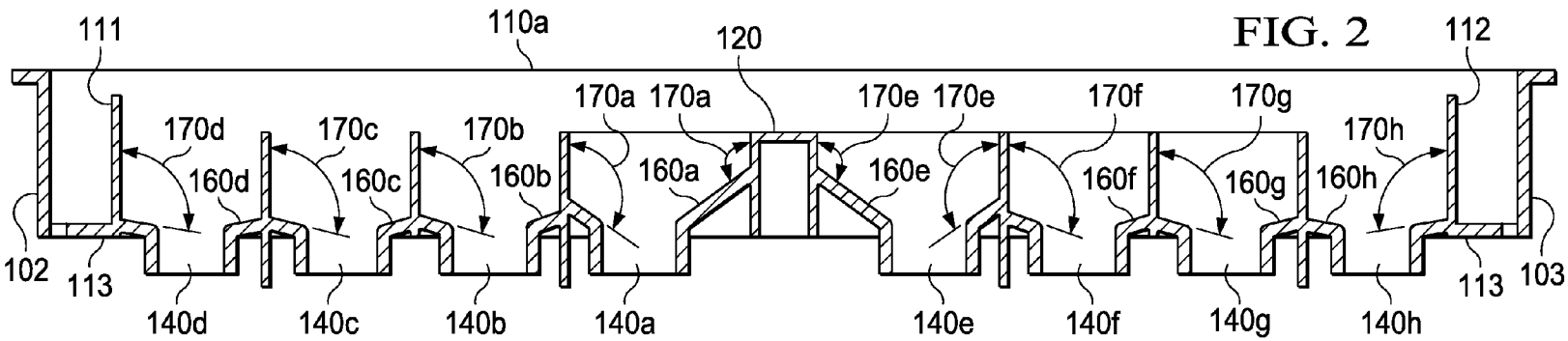
FIG. 2 illustrates a sectional view of the water distribution tray of FIG. 1 along plane 2-2.

Referring now to FIG. 2, illustrated is a sectional view of the water distribution tray 100 of FIG. 1 along plane 2-2. Commencing from the central water-impingement pedestal 120 and proceeding along the centerline 101 toward a first end 102, there is shown discharge apertures 140*a*-140*d*, in order. Similarly, commencing from the central water-impingement pedestal 120 and proceeding along the centerline 101 toward a second end 103, there is shown discharge apertures 140*e*-140*h*, in order. Associated with the first discharge aperture 140*a* is a downwardly sloping surface 160*a* that comprises channel 130*a*. Examining the area on either side of the first discharge aperture 140*a*, it can be seen that the slope on each side leading to the aperture 140*a* is identical and is represented by a first declension angle 170*a* measured from a vertical normal to the bottom 113. That is, downwardly sloping surface 160*a* (i.e., channel 130*a*) has a constant slope in all 360° around the first discharge aperture 140*a*. This surface 160*a* can be likened to the inside surface of a funnel except that the surface 160*a* terminates when it intersects inner vertical walls 150*a*, 150*b*, or the central water-impingement pedestal 120. In a preferred embodiment, the first declension angle 170*a* is about 125° measured from the vertical.

Associated with the second discharge aperture 140*b* is a second downwardly sloping surface 160*b* that comprises channel 130*b*. Around the second discharge aperture 140*b*, it can again be seen that the slope on each side of the second discharge aperture 140*b* is identical and is associated with a second declension angle 170*b* measured from the vertical. That is, the second downwardly sloping surface 160*b* (i.e., channel 130*b*) has a constant slope in all 360° around the second discharge aperture 140*b*. In a like manner as with the first downwardly sloping surface 160*a*, the second downwardly sloping surface 160*b* terminates when it intersects inner vertical walls 150*a*, 150*b*, 150*h*, the outer wall 110*a*, or the central water-impingement pedestal 120. The second declension angle 170*b* is less than the first declension angle 170*a*. In a preferred embodiment, the second declension angle 170*b* is about 104.3°.

One who is of skill in the art will take notice that the third discharge aperture 140*c* is surrounded by a third downwardly sloping surface 160*c* that comprises the third channel 130*c*. The third downwardly sloping surface 160*c* terminates when it intersects inner vertical walls 150*b* or 150*c*, the outer wall 110*a*, or the central water-impingement pedestal 120. The slope on each side of the third discharge aperture 140*c* is identical and is associated with a third declension angle 170*c* measured from the vertical. The third declension angle 170*c* is less than the second declension angle 170*b*. In a preferred embodiment, the third declension angle 170*c* is about 98.8°.

Furthermore, the fourth discharge aperture 140*d* is surrounded by a fourth downwardly sloping surface 160*d* that comprises the fourth channel 130*d*. The fourth downwardly sloping surface 160*d* terminates when it intersects inner vertical walls 150*c*, 150*d*, the outer walls 110*a* or 110*b*, the first end wall 111, or the central water-impingement pedestal 120. The slope on each side of the fourth discharge aperture 140*d* is identical and is associated with a fourth declension angle 170*d* measured from the vertical. The fourth declension angle 170*d* is less than the third declension angle 170*c*. In a preferred embodiment, the fourth declension angle 170*d* is about 96.0°.

In a like manner, fifth through eighth discharge apertures 140*e*-140*h* are arrayed from the central water-impingement pedestal 120 along the centerline 101 toward the second end 103. It should be apparent to one who is of skill in the art that the fifth through eighth discharge apertures 140*e*-140*h* and their corresponding channels 130*e*-130*h* are analogous to the first through fourth discharge apertures 140*a*-140*d* and their corresponding channels 130*a*-130*d*. The fifth declension angle 170*e* is substantially equal to the first declension angle 170*a*. The sixth declension angle 170*f* is substantially equal to the second declension angle 170*b*; and the seventh declension angle 170*g* is substantially equal to the third declension angle 170*c*. The eighth declension angle 170*h* is substantially equal to the fourth declension angle 170*d*.

With the channel angle 131*a*-131*h* for each channel 130*a*-130*h* being equal, water impinging on the water impingement pedestal 120 and flowing to the channels 130*a*-130*h* should be substantially equal within each channel 130*a*-130*h*. Therefore, a substantially equal volume of water is being distributed to each channel 130*a*-130*h*. Because the first and fifth discharge apertures 140*a*, 140*e* are closest to the water impingement pedestal 120, the first and fifth channels 130*a*, 130*e* have the largest declension angles 170*a*, 170*e*. Because the second and sixth discharge apertures 140*b*, 140*f* are closer to the water impingement pedestal 120 than the third and seventh discharge apertures 140*c*, 140*g*, declension angles 170*b*, 170*f* for channels 130*b*, 130*f* are less than declension angles 170*a*, 170*e*, but greater than declension angles 170*c*, 170*g*. In a like manner, declension angles 170*c*, 170*g* for channels 130*c*, 130*g* are less than declension angles 170*b*, 170*f*, but greater than declension angles 170*d*, 170*h*.

The present invention was successfully tested against the prior art upon which it was based. The general plan design for the present invention is essentially that as disclosed in U.S. Pat. No. 4,125,576 to Kozinski which is incorporated herein by reference. Relationship of the water distribution tray to other elements of the humidifier, e.g., frame, water-retaining pad, etc., may be gleaned from Kozinski and are therefore not included here. However, Kozinski did not employ downwardly sloping channels, but rather a flat bottom surface throughout the tray. Both trays were tested in three conditions: level, 2° of tray tilt (¼ bubble of a carpenter's bubble level), and 3.5° of tray tilt (1 full bubble), simulating installation of the humidifier in normal and abnormal positions. It should be noted that to install a heating duct at one full bubble off of level would likely be an extreme case, although it would likely not affect the functioning of the heating system itself.

Referring now to FIG. 3, illustrated is a table of comparative results testing a conventional water distribution tray versus the present invention as shown in FIGS. 1 and 2. Flow through discharge apertures 1-8 was collected over a 10 minute period for each tray at a level condition, at 2° of tilt and at 3.5° of tilt. Actual flow was then normalized by converting actual flow for each aperture into percent of the total flow. Percentages may not total 100 percent for a tray because of data rounding. The standard deviation was calculated as a measure of how evenly water was distributed by the tray in question. As can be seen in FIG. 3, with both trays level, the standard deviation between discharge apertures of the prior art tray was 11.8% of the flow over 10 minutes; while the standard deviation between discharge apertures of the present invention was only 1.3% of the flow. Similarly at 2° of tilt, the standard deviation between discharge apertures of the prior art tray was 7.55% of the flow; while the standard deviation between discharge apertures of the present invention was only 2.3% of the flow. Therefore, the present invention is a significant improvement over the prior art. This can be attributed to two features of the present invention: (a) each channel is downwardly inclined toward the discharge apertures from all 360° around the discharge apertures thereby eliminating pooling caused by tray tilt, and (b) the downwardly inclined channels have varying declension angles in order to efficiently dispense the water accumulated from the water-impingement pedestal. Even with up to 3.5° (one bubble) of tray tilt from level, there exists a downward slope of 0.5° in the fourth and eighth channels toward the discharge apertures, and significantly larger downward slopes in the other six channels, thus ensuring emptying of each channel and no pooling. It is unlikely that a humidifier with associated water distribution tray would be installed more than one-half bubble) (2°) off of level.

Thus, an improved humidifier water distribution tray has been described that provides downwardly sloping surfaces at varying angles of declension to efficiently and reliably deliver water to a humidifier pad for evaporation. Testing shows that the present invention more evenly delivers the water across the width of the humidifier pad and eliminates pooling.

Although the present invention has been described in detail, those skilled in the art should understand that they can make various changes, substitutions and alterations herein without departing from the spirit and scope of the invention in its broadest form.

What is claimed is:

1. A water distribution tray, comprising:

a water impingement pedestal positioned in an elongate tray having a plurality of vertical walls extending outwardly from said pedestal to form a plurality of channels;

a corresponding plurality of discharge apertures extending through a bottom of said water distribution tray;

a first downwardly inclined surface commencing at a base of said water impingement pedestal within a first of said plurality of channels and ending at a corresponding first of said plurality of discharge apertures, wherein said first downwardly inclined surface has a first declension angle associated therewith; and a second downwardly inclined surface commencing at said base within a second of said plurality of channels and ending at a corresponding second of said plurality of discharge apertures, wherein said second downwardly inclined surface has a second declension angle associated therewith different from said first declension angle.

2. The water distribution tray as recited in claim 1 wherein said first of said plurality of discharge apertures is proximate said water impingement pedestal along a centerline of said elongate tray toward a first end of said elongate tray.

3. The water distribution tray as recited in claim 2 wherein said second of said plurality of discharge apertures is distal said water impingement pedestal and proximate said first of said plurality of discharge apertures along said centerline toward said first end.

4. The water distribution tray as recited in claim 1 wherein said second declension angle is less than said first declension angle.

5. The water distribution tray as recited in claim 2 further comprising a third downwardly inclined surface commencing at said base within a third of said plurality of channels and ending at a corresponding third of said plurality of discharge apertures, wherein said third downwardly inclined surface has a third declension angle associated therewith, and wherein said third declension angle is less than said second declension angle.

6. The water distribution tray as recited in claim 5 wherein said third of said plurality of discharge apertures is distal said water impingement pedestal and proximate said second of said plurality of discharge apertures along said centerline toward said first end.

7. The water distribution tray as recited in claim 5 further comprising a fourth downwardly inclined surface commencing at said base within a fourth of said plurality of channels and ending at a corresponding fourth of said plurality of discharge apertures, wherein said fourth downwardly inclined surface has a fourth declension angle associated therewith, and wherein said fourth declension angle is less than said third declension angle.

8. The water distribution tray as recited in claim 7 wherein said fourth of said plurality of discharge apertures is distal said water impingement pedestal and proximate said third of said plurality of discharge apertures along said centerline toward said first end.

9. The water distribution tray as recited in claim 7 further comprising: a fifth downwardly inclined surface commencing at said base within a fifth of said plurality of channels and ending at a corresponding fifth of said plurality of discharge apertures, wherein said fifth downwardly inclined surface has a fifth declension angle associated therewith, wherein said fifth declension angle is substantially equal to said first declension angle, and wherein said fifth of said plurality of discharge apertures is proximate said water impingement pedestal along said centerline toward a second opposite end of said elongate tray.

10. The water distribution tray as recited in claim 9 further comprising: a sixth downwardly inclined surface commencing at said base within a sixth of said plurality of channels and ending at a corresponding sixth of said plurality of discharge apertures, wherein said sixth downwardly inclined surface has a sixth declension angle associated therewith, wherein said sixth declension angle is substantially equal to said second declension angle, and wherein said sixth of said plurality of discharge apertures is distal said water impingement pedestal and proximate said fifth of said plurality of discharge apertures along said centerline toward said second opposite end.

11. The water distribution tray as recited in claim 10 further comprising: a seventh downwardly inclined surface commencing at said base within a seventh of said plurality of channels and ending at a corresponding seventh of said plurality of discharge apertures, wherein said seventh downwardly inclined surface has a seventh declension angle associated therewith, wherein said seventh declension angle is substantially equal to said third declension angle, and wherein said seventh of said plurality of discharge apertures is distal said water impingement pedestal and proximate said sixth of said plurality of discharge apertures along said centerline toward said second opposite end.

12. The water distribution tray as recited in claim 11 further comprising an eighth downwardly inclined surface commencing at said base within an eighth of said plurality of channels and ending at a corresponding eighth of said plurality of discharge apertures, wherein said eighth downwardly inclined surface has an eighth declension angle associated therewith, wherein said eighth declension angle is substantially equal to said fourth declension angle, and wherein said eighth of said plurality of discharge apertures is distal said water impingement pedestal and proximate said seventh of said plurality of discharge apertures along said centerline toward said second opposite end.

13. A method of manufacturing a water distribution tray, comprising:

forming a water impingement pedestal positioned in an elongate tray having a plurality of vertical walls extending outwardly from said pedestal to form a plurality of channels;

forming a corresponding plurality of discharge apertures extending through a bottom of said water distribution tray;

forming a first downwardly inclined surface commencing at a base of said water impingement pedestal within a first of said plurality of channels and ending at a corresponding first of said plurality of discharge apertures, wherein said first downwardly inclined surface has a first declension angle associated therewith; and forming a second downwardly inclined surface commencing at said base within a second of said plurality of channels and ending at a corresponding second of said plurality of discharge apertures, wherein said second downwardly inclined surface has a second declension angle associated therewith different from said first declension angle.

14. The method as recited in claim 13 wherein forming a first downwardly inclined surface includes forming said first of said plurality of discharge apertures proximate said water impingement pedestal along a centerline of said elongate tray toward a first end of said elongate tray.

15. The method as recited in claim 14 wherein forming a second downwardly inclined surface includes forming said second of said plurality of discharge apertures distal said water impingement pedestal and proximate said first of said plurality of discharge apertures along said centerline toward said first end.

16. The method as recited in claim 13 wherein forming a second downwardly inclined surface includes forming a second downwardly inclined surface wherein said second declension angle is less than said first declension angle.

17. The method as recited in claim 14 further comprising forming a third downwardly inclined surface commencing at said base within a third of said plurality of channels and ending at a corresponding third of said plurality of discharge apertures, wherein said third downwardly inclined surface has a third declension angle associated therewith, and wherein said third declension angle is less than said second declension angle.

18. The method as recited in claim 17 wherein forming said third of said plurality of discharge apertures includes forming said third of said plurality of discharge apertures distal said water impingement pedestal and proximate said second of said plurality of discharge apertures along said centerline toward said first end.

19. The method as recited in claim 17 further comprising forming a fourth downwardly inclined surface commencing at said base within a fourth of said plurality of channels and ending at a corresponding fourth of said plurality of discharge apertures, wherein said fourth downwardly inclined surface has a fourth declension angle associated therewith, and wherein said fourth declension angle is less than said third declension angle.

20. The method as recited in claim 19 wherein forming said fourth of said plurality of discharge apertures includes forming said fourth of said plurality of discharge apertures distal said water impingement pedestal and proximate said third of said plurality of discharge apertures along said centerline toward said first end.

21. The method as recited in claim 19 further comprising forming a fifth downwardly inclined surface commencing at said base within a fifth of said plurality of channels and ending at a corresponding fifth of said plurality of discharge apertures, wherein said fifth downwardly inclined surface has a fifth declension angle associated therewith, wherein said fifth declension angle is substantially equal to said first declension angle, and wherein said fifth of said plurality of discharge apertures is proximate said water impingement pedestal along said centerline toward a second opposite end of said elongate tray.

22. The method as recited in claim 21 further comprising forming a sixth downwardly inclined surface commencing at said base within a sixth of said plurality of channels and ending at a corresponding sixth of said plurality of discharge apertures, wherein said sixth downwardly inclined surface has a sixth declension angle associated therewith, wherein said sixth declension angle is substantially equal to said second declension angle, and wherein said sixth of said plurality of discharge apertures is distal said water impingement pedestal and proximate said fifth of said plurality of discharge apertures along said centerline toward said second opposite end.

23. The method as recited in claim 22 further comprising forming a seventh downwardly inclined surface commencing at said base within a seventh of said plurality of channels and ending at a corresponding seventh of said plurality of discharge apertures, wherein said seventh downwardly inclined surface has a seventh declension angle associated therewith, wherein said seventh declension angle is substantially equal to said third declension angle, and wherein said seventh of said plurality of discharge apertures is distal said water impingement pedestal and proximate said sixth of said plurality of discharge apertures along said centerline toward said second opposite end.

24. The method as recited in claim 23 further comprising forming an eighth downwardly inclined surface commencing at said base within an eighth of said plurality of channels and ending at a corresponding eighth of said plurality of discharge apertures, wherein said eighth downwardly inclined surface has an eighth declension angle associated therewith, wherein said eighth declension angle is substantially equal to said fourth declension angle, and wherein said eighth of said plurality of discharge apertures is distal said water impingement pedestal and proximate said seventh of said plurality of discharge apertures along said centerline toward said second opposite end.

* * * * *